United States Patent [19]

Rogalski

[11] 4,214,784

[45] Jul. 29, 1980

[54] ASH REMOVER

[76] Inventor: Carl E. Rogalski, 40 Heights Rd., Stratham, N.H. 03885

[21] Appl. No.: 34,175

[22] Filed: Apr. 27, 1979

[51] Int. Cl.[2] ..... F23J 1/04

[52] U.S. Cl. ..... 294/55; 294/9

[58] Field of Search ..... 294/9, 10, 49, 50, 51, 294/55; 15/104.8, 257.1, 257.6, 257.7

[56] References Cited

U.S. PATENT DOCUMENTS

| | | | |
|---|---|---|---|
| 507,826 | 10/1893 | Miller | 294/55 |
| 1,474,634 | 11/1923 | Johanns | 294/55 |
| 1,762,347 | 6/1930 | Peebles | 294/55 |
| 2,295,670 | 9/1942 | Maloney | 294/49 |

FOREIGN PATENT DOCUMENTS

| | | | |
|---|---|---|---|
| 469216 | 11/1928 | Fed. Rep. of Germany | 294/55 |
| 55310 | 5/1920 | Sweden | 294/55 |

*Primary Examiner*—Johnny D. Cherry
*Attorney, Agent, or Firm*—Thomas N. Tarrant

[57] ABSTRACT

An ash remover having an ash rake which cooperates with a bracket on the cover of the ash remover to hold the cover closed when transporting ashes.

7 Claims, 2 Drawing Figures

ASH REMOVER

BACKGROUND OF THE INVENTION

1. Field of the Invention

This invention relates to implements for removing and transporting ashes from stoves, furnaces or fireplaces.

2. Description of the Prior Art

Various implements have been used in the past for aiding in the removal of ashes and cinders. For example, U.S. Pat. No. 1,474,634 discloses an ash remover with a carrying handle which is attached through the main body to the cover of the ash remover to hold it closed for transportation of ashes. Similarly, U.S. Pat. No. 507,862 discloses an ash remover having a spring-loaded cover to hold it closed for transportation of ashes. In neither of these approaches is any provision made to enable the convenient operation of an ash rake to aid in filling of the ash remover. The spring-load cover disclosed in U.S. Pat. No. 507,826 poses a fairly complex arrangement of parts to hold the cover closed. The ash remover disclosed in U.S. Pat. No. 1,474,634 requires that the ash remover be suspended from the carrying handle when loaded, or else the contents could fall out.

SUMMARY OF THE INVENTION

Now, in accordance with the present invention, as ash remover is provided having a main body for carrying ashes and a cover movably connected to the main body. A bracket is secured to the cover. An ash rake is provided, comprising a handle which movably passes into the main body and a rake fastened at one end of the handle and capable of engaging the bracket on the cover for securing it.

Accordingly, it is an object of this invention to provide an ash remover with a convenient ash rake for filling the ash remover.

Another object of this invention is to provide an ash remover with a simple arrangement to hold the cover closed during transport of ashes.

Other objects of this invention will become apparent from reading the description of the preferred embodiment in conjunction with the drawing.

DESCRIPTION OF THE PREFERRED EMBODIMENT

Figure 1:
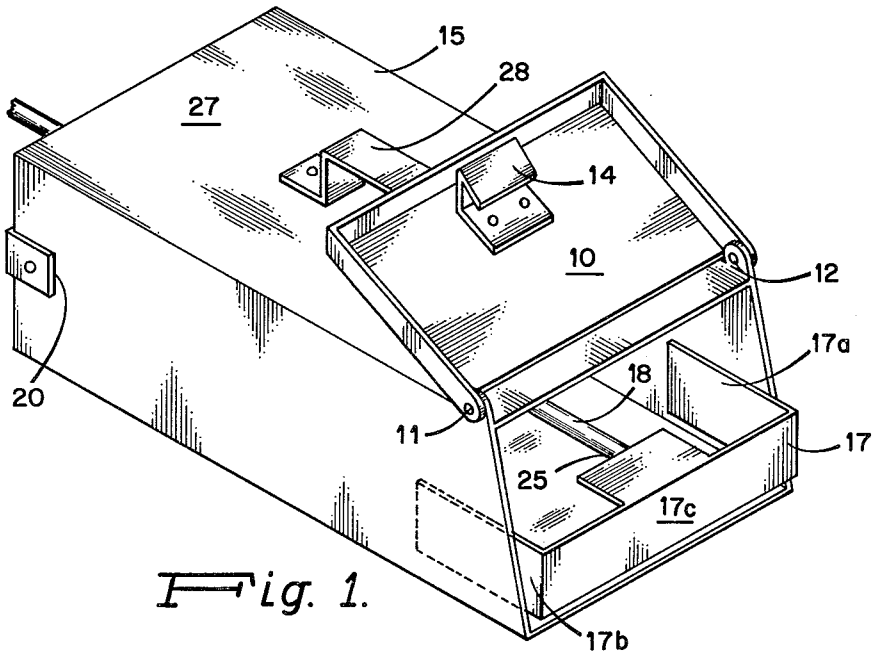
FIG. 1 is a perspective view of a preferred embodiment of the present invention.

A preferred embodiment of the present invention is herein described as shown in FIG. 1. The ash remover of FIG. 1 has cover 10 which revolves on rivets 11 and 12. Cover 10 measures approximately 10 cm in height and 23 cm in width. All remaining dimensions, unless otherwise noted, are proportionately based on these and are only exemplary. Attached by rivets securely to the inside of cover 10 is bracket 14. Bracket 14 is suitably fashioned from 3.175 mm thick bar stock steel. It is placed near the bottom of cover 10, and it defines approximately a "U"-shape when viewed from the side of the ash remover. Bracket 14 is arranged so that the opening of the "U" is a channel lying parallel with both cover 10 and rake 17 for receiving rake 17.

Figure 2:
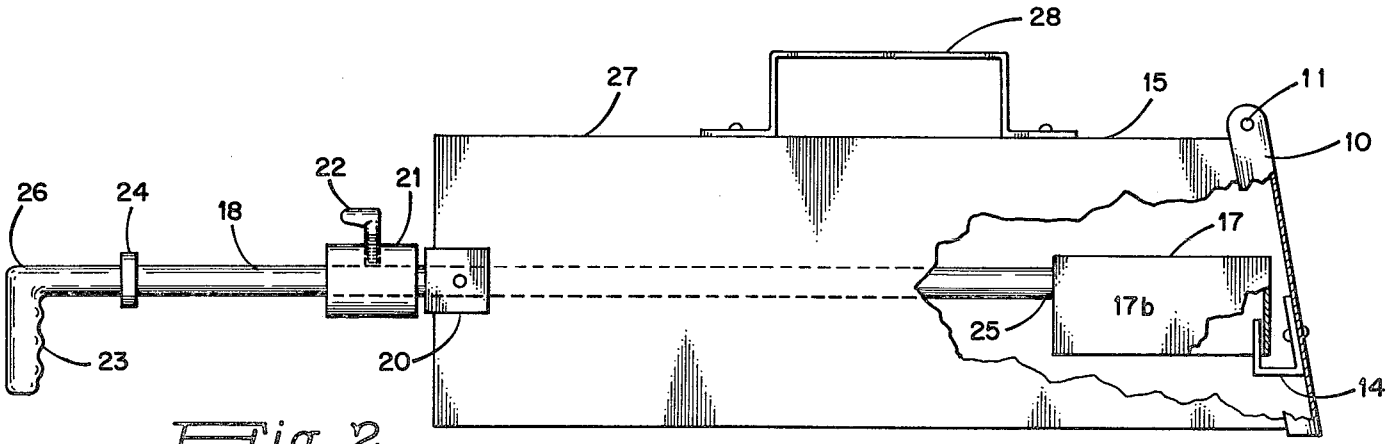
FIG. 2 is a side elevation of the preferred embodiment with a portion of the ash rake broken away, and a portion of the ash remover broken away.
Figure 3:
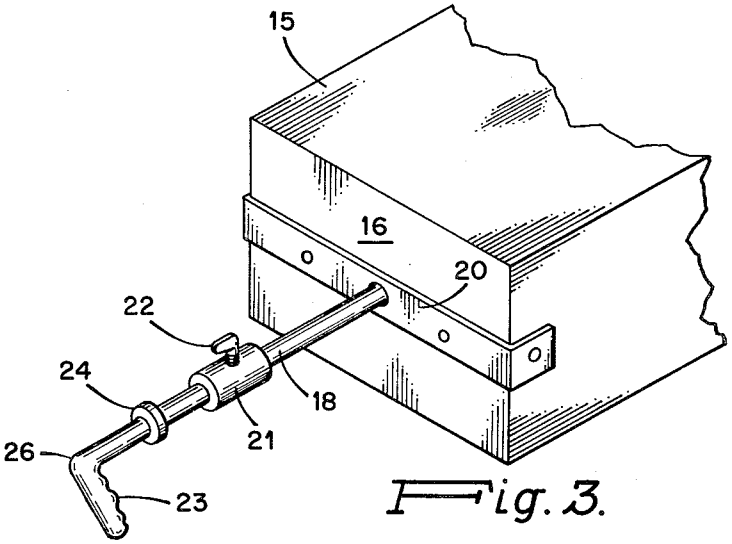
FIG. 3 is partial perspective view of one end portion of the preferred embodiment showing the ash rake handle.

Movably disposed within main body 15 is rake 17. One end 25 of handle 18 is securely fastened to rake 17, for example by welding, using a gusset plate. Hand grip 23 is formed at other end 26 of handle 18 as shown in FIGS. 2 and 3. Hand grip 23 may be formed merely by bending a metal rod used as handle 18 or it may be a separate material attached to or over handle 18. Handle 18 extends through end 16 of body 15 and through pivot brace 20 as depicted in FIG. 3. Pivot brace 20, mounted at end 16, alleviates stresses and strains on main body 15 by supporting handle 18 as it passes through the anterior wall of the ash remover. Pivot brace 20 is suitably made from 3.175 mm thick bar stock steel, and it is fastened to main body 15 with rivets.

Clamp 21 surrounds and slides on handle 18 as shown in FIGS. 2 and 3. Set screw 22 is screwed into a threaded bore in clamp 21 which extends through to handle 18. This permits clamp 21 to be locked in position on handle 18 by tightening set screw 22. When clamp 21 is against stop 24 and set screw 22 is tightened against scraper rod 18, the combination of the handle 23 and 21 form a convenient handle for operating the ash remover.

Stop 24 is a metal ring affixed to handle 18 which limits the travel range of clamp 21 on handle 18, and consequently, limits the extent to which rake 17 can be protruded out the front of the ash remover. Rake 17, as depicted, is made of a flat metal plate **17*c* traversing body 15 and having wings 17*a* and 17*b* extending back on either side into body 15. Wings 17*a* and 17*b* keep rake 17 aligned with body 15. The length of handle 18 forward of stop 24, the length of clamp 21, the length of the ash remover, and the length of wings 17*a* and 17*b* of ash rake 17 are chosen so that a portion of wings 17*a* and 17*b* always remains within main body 15 of the ash remover. Otherwise a difficulty in reinserting rake 17 into main body 15** would exist.

The ash remover is conveniently carried by handle 28 which is riveted to upper surface 27 of main body 15. It is suitably fashioned from 3.175 mm thick bar stock steel.

To use the above-described ash remover, rake 17 would be unlatched from bracket 14 by loosening set screw 22 and sliding clamp 21 adjacent to stop 24, and the ash remover would be inserted into a collection area for ashes. Hand grip 23 of handle 18 is then manipulated to maneuver rake 17 in a raking fashion to draw ashes within main body 15. Upon substantially filling the ash remover, rake 17 is drawn within main body 15 and cover 10 is closed within the ash collection area if space permits. Rake pan 17 is then maneuvered by hand grip 24 to engage plate **17*c* into bracket 14. Hand grip 23 is then drawn away from main body 15 causing bracket 14 to tightly engage rake 17. Clamp 21 is slid adjacent to pivot bracket 20 and locked in place by tightening set screw 22. This locks cover 10** shut.

While the invention has been described in relation to a specific embodiment, modifications will occur to those skilled in the art. For example, cover 10 could be designed to "hug" main body 15 as it was opened. One way of accomplishing this would be to create vertical slots on the side members of cover 10, which presently contact rivets 11 and 12. These rivets would be disposed within the slots to connect cover 10 to main body 15 and to guide the movement of cover 10 as it is being opened.

Another modification would be to replace clamp 21 and set screw 22 with a spring, which would surround handle 18 as clamp 21 presently does, and a cocking mechanism. The spring would be cocked in a constricted position when the ash remover was being loaded, and it would be uncocked to cause latch 14 to tightly engage rake pan 17. In other modifications handle 18 of rake 17 can enter body 15 through the top or some other point than end 16. Other ways of connecting cover 10 to main body 15, and other methods of securing handle 18 are available and are contemplated as within the scope of the invention.

These and other modifications which will occur to one skilled in the art are deemed to be within the spirit and scope of the appended claims except as expressly limited otherwise.

I claim:

1. An ash remover comprising:

(a) a main body for carrying ashes;

(b) a cover movably connected to the main body;

(c) a bracket secured to the cover; and, (d) an ash rake comprising:

(1) a handle which movably passes into the main body;

(2) rake means fastened at one end of said handle for raking ashes into said body and also for engaging said bracket to hold said cover in a closed position.

2. An ash remover according to claim 1 further comprising means to secure the handle of the ash rake fixed for holding said cover closed.

3. An ash remover according to claim 2 wherein said means to secure the handle comprises a clamp mounted on said handle.

4. An ash remover according to claim 3 wherein the clamp comprises a set screw and a clamp body which surrounds the handle of the ash rake, wherein the set screw may be tightened against the handle to hold the clamp stationary on the handle.

5. An ash remover according to claims 1, 2, or 3 further comprising stop means to prevent the rake from completely passing through the main body of the ash remover when the rake is maneuvered by the handle.

6. An ash remover according to claim 1 wherein said rake comprises a plate traversing said body and two wings extending from said plate on either side back into said body to maintain said rake in alignment with said body.

7. An ash remover according to claim 6 wherein a stop is mounted on said handle at a position to prevent the handle from entering the main body so far that said wings pass out beyond said main body.

* * * * *